US006632101B1

(12) United States Patent
Ma

(10) Patent No.: US 6,632,101 B1
(45) Date of Patent: Oct. 14, 2003

(54) ZIF SOCKET CONNECTOR

(75) Inventor: Hao-Yuan Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/112,975

(22) Filed: Mar. 28, 2002

(30) Foreign Application Priority Data

Dec. 21, 2001 (TW) ..... 90222540 U

(51) Int. Cl.[7] ..... H01R 13/62
(52) U.S. Cl. ..... 439/342; 439/259
(58) Field of Search ..... 439/342, 259, 439/266, 260, 261, 262, 263, 264, 265

(56) References Cited

U.S. PATENT DOCUMENTS 6,210,197 B1 * 4/2001 Yu ..... 439/342
6,457,986 B2 * 10/2002 Hirata ..... 439/342

* cited by examiner

*Primary Examiner*—Alexander Gilman
(74) *Attorney, Agent, or Firm*—Wei Te Chung

(57) ABSTRACT

An electrical socket connector (1) comprises a base (2), a cover (3), and a locker means (5). The base has a plurality of contact passageways (21) defined from an upper surface (27) to a bottom surface (28) thereof and at least a first protruding portion (24) on one side thereof. The first protruding portion has a first receiving slot (26) defined therein. A plurality of contacts (4) are received in the passageways of the base. The cover is moveably mounted on an upper surface of the base and defines a plurality of receiving holes (31) in alignment with the contact passageways adapted to receive corresponding pins of an IC module to extend therethrough into the passageways. The locker means comprises a stopper portion (53) and a locker portion (52) extending from the stopper portion. The stopper portion abuts against one side of the cover near the first protruding portion and the locker portion is received in the first receiving slot of the first protruding portion and engaging with the first protruding portion thereby preventing the cover from moving on the base.

5 Claims, 4 Drawing Sheets

ZIF SOCKET CONNECTOR

BACKGROUND OF THE INVENTION

1. Field of the Invention

The present invention relates to a zero insertion force (ZIF) socket connector, and particularly to a ZIF socket connector having a locker means for ensuring pins of a chip to reliably electrically connect with contacts of the ZIF socket connector when the connector is moved from an open position to a close position.

2. Description of Related Art

U.S. Pat. Nos. 5,489,218 and 5,679,020 disclose two conventional ZIF socket connectors. These conventional socket connectors each comprise a lever positioned between a cover and a base. The lever has a cam shaft and can drive the cover to move relative to the base from an open position wherein the pins of a chip are disconnected with contacts received in the base to a close position wherein the pins of the chip electrically connect with the contacts in the base. The lever has a pivotal movement to drive the cover to move relative to the base. The lever which has a cam shaft has a complicate structure; thus, the cost for manufacturing the conventional socket connectors is relatively high. Furthermore, the lever needs to occupy an area of a printed circuit board on which the connector is mounted.

U.S. Pat. No. 5,730,615 discloses another design of a ZIF socket connector. Referring to FIG. 5, the socket connector comprises a base 6, a cover 7 movably mounted on the base 6, and a plurality of contacts (not shown) received in the base 6. A plurality of pins of a chip 8 is inserted into a plurality of holes defined in the cover 7 and the cover 7 can be moved relative to the base 6 by inserting a tool 9 into a recess (not labeled) defined in the base 6 through a hole (not labeled) defined in the cover 7, and then moving the tool 9 to drive the cover 7 to move accordingly. The cover 7 can move from an open position wherein the pins of the chip are disconnected with the contacts of the socket connector to a close position wherein the pins of the chip connect with the contacts of the socket connector. The socket connector has a simplified structure and the area occupied by the socket connector on a printed circuit board is reduced. However, for such socket connector of FIG. 5, the cover 7 cannot be secured at the close position. A rebound of the cover 7 toward the open position after the cover 7 is moved by the tool 9 to the close position and the tool 9 is removed from the socket connector often happens to cause the pins not able to have a reliable connection with the contacts of the socket connector.

Hence, an improved ZIF socket connector which can ensure the socket connector in close position is required to overcome the disadvantages of the prior art.

SUMMARY OF THE INVENTION

An object of the present invention is to provide a ZIF socket connector with a locker means for ensuring the socket connector in close position.

In order to achieve the object set forth, a ZIF socket connector in accordance with the present invention comprises a base, a cover, and a locker means. The base haves a plurality of contact passageways defined from an upper surface to a bottom surface thereof and at least a first protruding portion on one side thereof. The first protruding portion has a first receiving slot defined therein. A plurality of contacts are received in the passageways of the base. The cover is moveably mounted on the upper surface of the base and defines a plurality of receiving holes in alignment with the contact passageways adapted to receive corresponding pins of an IC module to extend therethrough into the passageways. The locker means comprises a stopper portion and a locker portion extending from the stopper portion. The stopper portion abuts against one side of the cover near the first protruding portion and the locker portion is received in the receiving slot of the first protruding portion and engaging with the first protruding portion thereby preventing the cover from moving on the base.

Other objects, advantages and novel features of the invention will become more apparent from the following detailed description when taken in conjunction with the accompanying drawings.

DETAILED DESCRIPTION OF THE INVENTION

Figure 1:
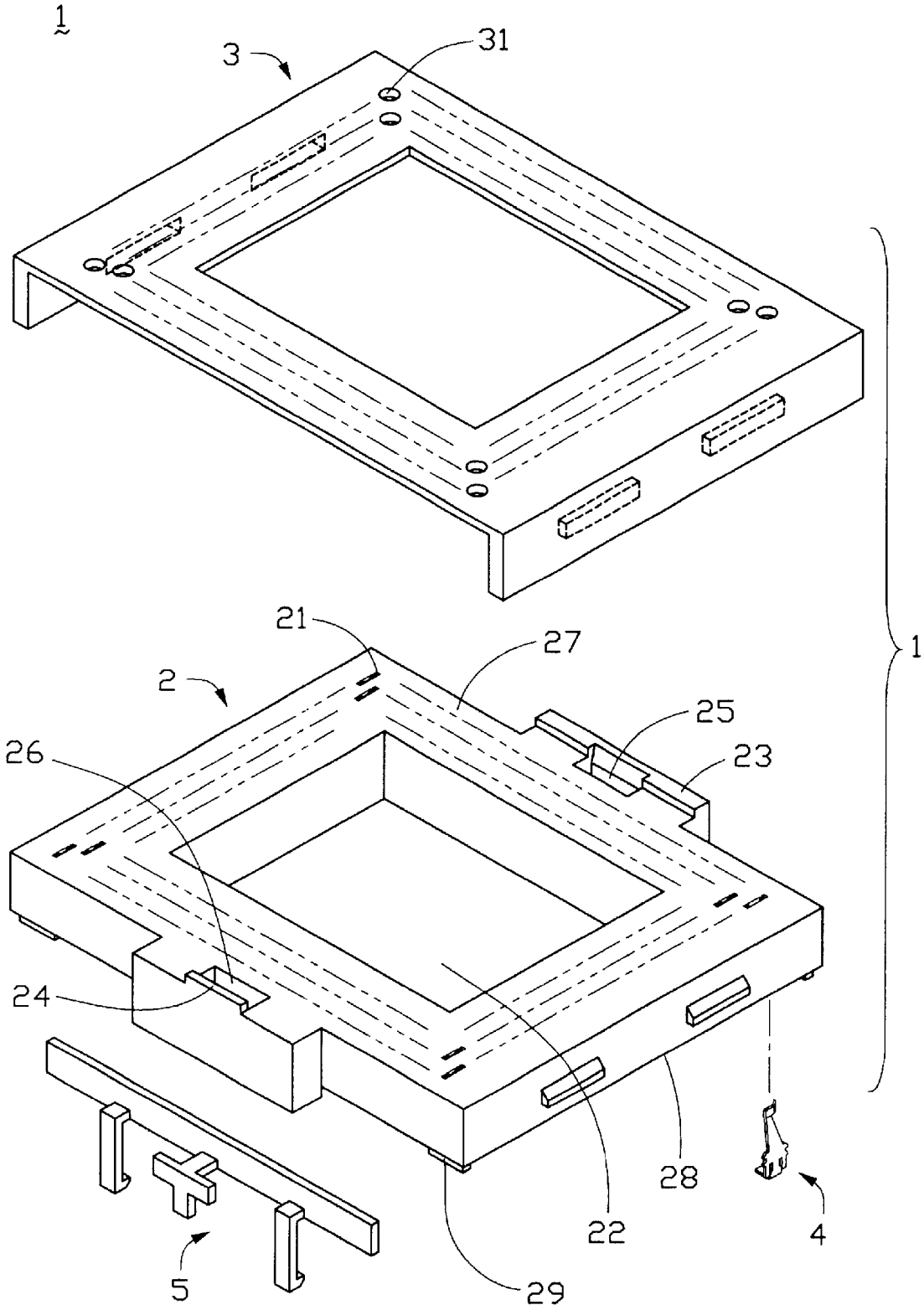
FIG. 1 is an exploded perspective view of a ZIF socket connector in accordance with the present invention.

Referring to FIG. 1, a ZIF socket connector 1 in accordance with the present invention comprises a base 2, a cover 3, a plurality of contacts 4 (only one shown), and a locker means 5.

The base 2 defines a plurality of passageways 21 through an upper surface 27 and a bottom surface 28 thereof and a rectangular aperture 22 in a center thereof. The plurality of contacts 4 are respectively received in the corresponding passageways 21. The base 2 has a first protruding portion 24 and a second protruding portion 23 on opposite sides thereof, functioning as actuation regions. The first and second protruding portion 24 and 23 define a first and a second receiving slots 26 and 25 therein respectively. Four standoffs 29 extend downwardly from four corners of the bottom surface 28 of the base 2, respectively.

The cover 3 is mounted on the upper surface 27 of the base 2 and defines a plurality of pin holes 31 in alignment with the passageways 21 for insertion of pins of a chip (not shown) through the holes 31 into the passageways 21. The cover 3 can be driven by a tool (not shown) inserted in the first receiving slot 26 to move from an open position wherein the cover 3 is adjacent to the first protruding portion 24 to a close position wherein the cover 3 is adjacent to the second protruding portion 23. The pins of the chip are disconnected with the contacts 4 received in the base 2 when the cover 3 is at the open position and the pins of the chip are electrically connected with the contacts 4 when the cover 3 is at the close position.

Figure 2:
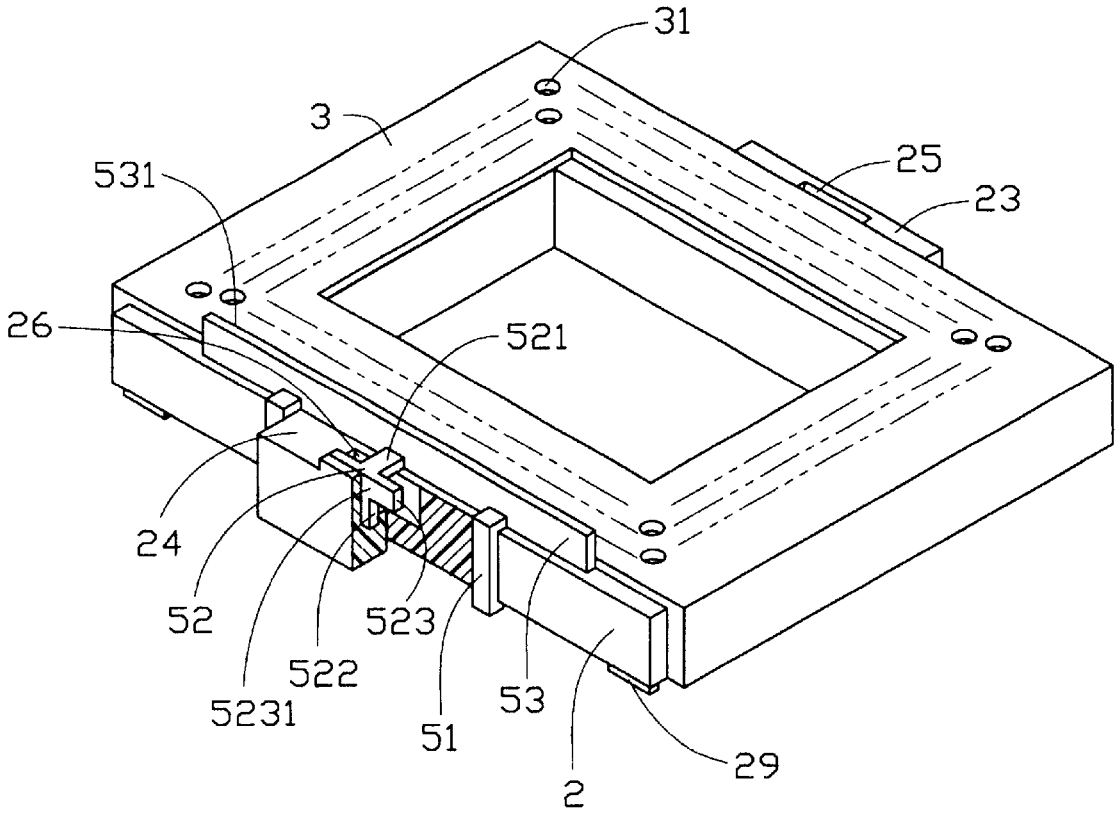
FIG. 2 is a view similar to FIG. 1 with a part of a base of the connector being moved.
Figure 3:
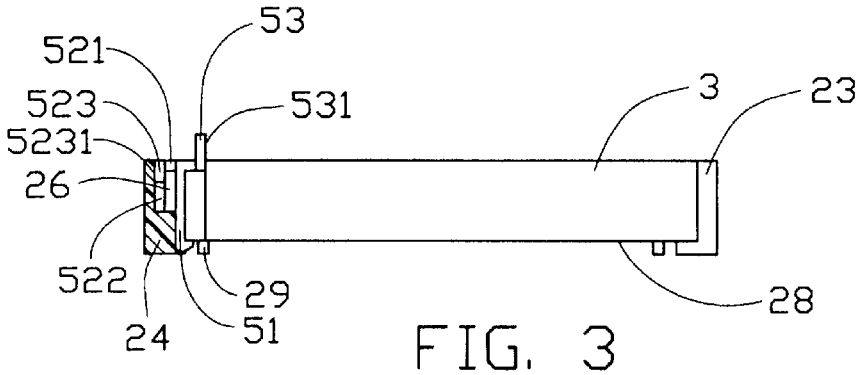
FIG. 3 is a side view of FIG. 2.
Figure 4:
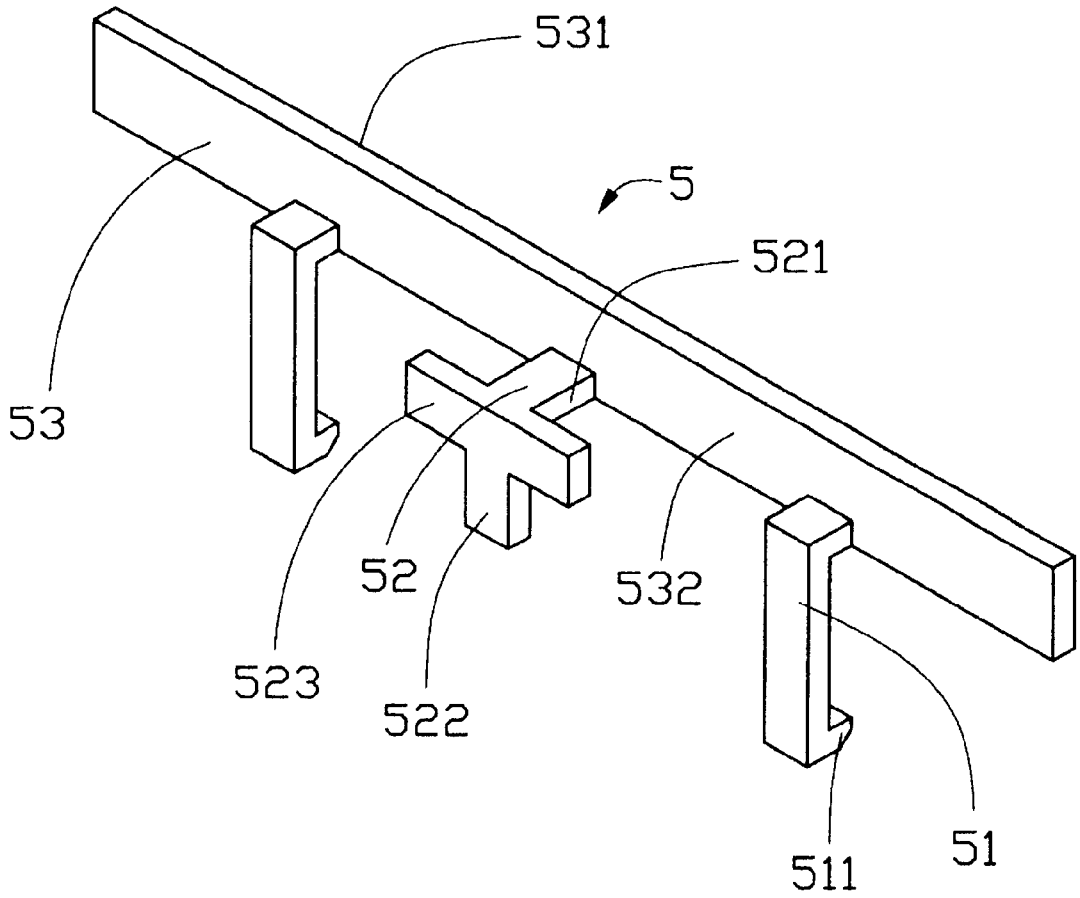
FIG. 4 is an enlarged perspective view of a locker means of the connector of FIG. 1.
Figure 5:
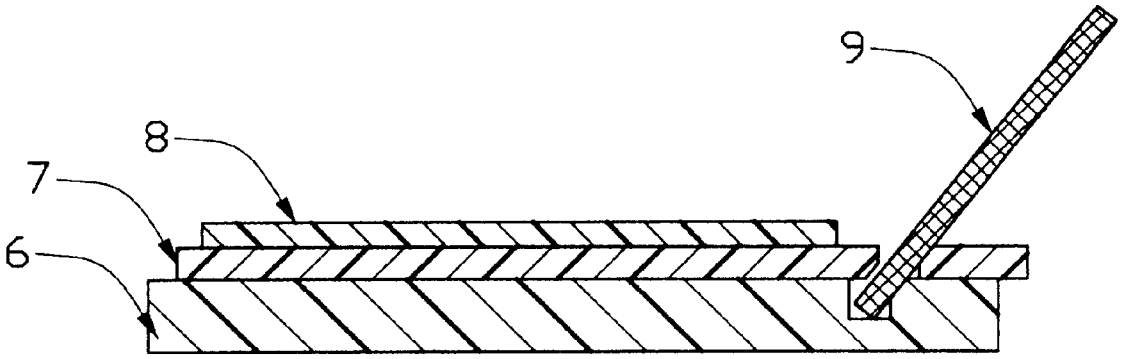
FIG.5 (PRIOR ART)
FIG. 5 is a cross-sectional view of a conventional ZIF socket connector.

Referring to FIGS. 2, 3 and 4, the locker means 5 comprises a stopper portion 53, a pair of hooks 51, and a locker portion 52. The stopper portion 53 has a stopper surface 531 abutting on one side of the cover 3 near the first protruding portion 24. The pair of hooks 51 is formed on a face 532 of the stopper portion 53 opposite the stopper surface 531 of the stopper portion 53 and extends downwardly. The locker portion 52 is formed between the pair of hooks 51 and comprises an extending portion 521 extending perpendicularly to the stopper. portion 53 and connecting with the face 532, a holder portion 522 extending downwardly from a free end of the extending portion 521. A pair of side portions 523 is formed at a joint of the extending portion 521 and the holder portion 522 and extends toward the hooks 51 whereby the side portions 523 are parallel to the stopper portion 53.

After the cover 3 is moved from the open position to the close position wherein the cover 3 is adjacent to the second protruding portion 23, the locker means 5 is assembled to the socket connector 1 to prevent the cover from returning to the open position by an unintended force. The locker means 5 is assembled to the socket connector 1 to a position in which the hooks 51 of the locker means 5 engage a side of the base 2 at a position beside the first protruding portion 24 in which lower fingers 511 of the hooks 51 abut against the bottom surface 28 of the base 2. The holder portion 522 of the locker portion 52 is inserted into the first receiving slot 26, and the stopper portion 53 abuts against the side of the cover 3 near the first protruding portion 24. The holder portion 522 and the side portion 523 abut against an outer sidewall of the first receiving slot 26. Thus, the cover 3 is locked by the locker means 5 at the close position and cannot be moved toward the first protruding portion 24 to return back to the open position. A thickness of each of the hooks 51 is less than a projecting length the first protruding portion from the side of the base 2 so that the locker means 5 will not increase the dimension of the connector, whereby an area of a printed circuit board occupied by the connector will not increase due to the mounting of the locker means 5 to the connector. Furthermore, a height of each standoff 29 extending beyond the bottom face 28. of the base 2 is larger than a thickness of the finger 511 of the hook 5 abutting against the bottom face 28 of the base 2.

It is to be understood, however, that even though numerous characteristics and advantages of the present invention have been set forth in the foregoing description, together. with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical socket connector adapted for mounting an integrated circuit (IC) module having a plurality of pins to a printed circuit board (PCB) comprising:

a base having a plurality of contact passageways defined from an upper surface to a bottom surface thereof and at least a first protruding portion on one side thereof, the first protruding portion having a first receiving slot defined therein;

a plurality of contacts received in the passageways of the base;

a cover moveably mounted on the upper surface of the base and defining a plurality of receiving holes in alignment with the contact passageways adapted to receive corresponding pins of the IC module to extend therethrough into the passageways; and a locker means comprising a stopper portion and a locker portion extending from the stopper portion, the stopper portion abutting against one side of the cover near the first protruding portion, the locker portion comprising an extending portion perpendicular to the stopper portion, a holder portion downward extending from the extending portion, and a pair of side portions formed at a joint of the extending portion and the holder portion and parallel to the stopper portion, the locker portion received in the receiving slot of the first protruding portion and engaging with the first protruding portion thereby preventing the cover from moving on the base.

2. The electrical socket connector as described in claim 1, wherein the locker means forms at least one hook on the stopper portion abutting against the one side and the bottom surface of the base.

3. The electrical socket connector as described in claim 1, wherein the base further comprises a second protruding portion on a side of the base opposite to the first protruding portion.

4. The electrical socket connector as described in claim 1, wherein the base comprises four standoffs downwardly extending from four corners of the bottom surface thereof, a height of each standoff extending beyond the bottom surface of the base is larger than a thickness of a portion of the hook abutting against the bottom surface of the base.

5. The electrical socket connector as described in claim 1, wherein the side portions and the holder portion abut against an outer sidewall of the first receiving slot.

* * * * *